US009266634B2

(12) United States Patent
Haschke et al.

(10) Patent No.: US 9,266,634 B2
(45) Date of Patent: Feb. 23, 2016

(54) CRIMP CONTROL APPARATUS

(71) Applicant: Precitec Corp., Mundelein, IL (US)

(72) Inventors: Eggo Haschke, Deerfield, IL (US); Hector Jones, Spring Grove, IL (US)

( * ) Notice: Subject to any disclaimer, the term of this patent is extended or adjusted under 35 U.S.C. 154(b) by 187 days.

(21) Appl. No.: 13/787,388

(22) Filed: Mar. 6, 2013

(65) Prior Publication Data

US 2014/0250830 A1 Sep. 11, 2014

(51) Int. Cl.
*B65B 51/04* (2006.01)

(52) U.S. Cl.
CPC ..... *B65B 51/04* (2013.01); *B65B 51/043* (2013.01); *B65B 51/046* (2013.01)

(58) Field of Classification Search
CPC ..... B65B 51/04; B65B 51/043; B65B 51/046
USPC ..... 29/243.56, 243.57, 252; 53/136.1–136.3, 136.5, 138.2–138.4
See application file for complete search history.

(56) References Cited

U.S. PATENT DOCUMENTS

| | | | | | |
|---|---|---|---|---|---|
| 2,165,504 | A * | 7/1939 | Pfauser | 72/392 |
| 2,628,420 | A * | 2/1953 | Skilling | 29/252 |
| 2,835,128 | A * | 5/1958 | Herrstrum | 73/842 |
| 2,886,816 | A * | 5/1959 | Hill | 29/33.52 |
| 3,237,290 | A * | 3/1966 | Frank | 29/243.57 |
| 3,368,322 | A * | 2/1968 | Yasui | 53/138.4 |
| 3,543,378 | A * | 12/1970 | Klenz | 29/243.57 |
| 3,574,915 | A * | 4/1971 | Jeal | 29/243.519 |
| 3,583,056 | A * | 6/1971 | Klenz | 29/243.57 |
| 3,717,972 | A * | 2/1973 | Niedecker | 53/138.4 |
| 3,786,550 | A * | 1/1974 | Jones | 29/238 |
| 3,791,011 | A * | 2/1974 | Keys | 29/252 |
| 3,913,628 | A * | 10/1975 | Keating et al. | 140/82 |
| 4,259,858 | A * | 4/1981 | Freeman et al. | 29/243.523 |
| 7,251,879 | B2 | 8/2007 | Gosis et al. | |
| 7,914,364 | B2 * | 3/2011 | Mysker | 452/32 |
| 8,028,497 | B2 * | 10/2011 | Griggs et al. | 53/138.4 |
| 8,640,323 | B2 * | 2/2014 | Kodi | 29/525.01 |
| 2011/0107726 | A1 | 5/2011 | Haschke | |

OTHER PUBLICATIONS

PCT International Search Report, International Searching Authority, pp. 1-3, Jun. 20, 2014.
Written Opinion of the International Searching Authority, pp. 1-4; Jun. 20, 2014.

* cited by examiner

*Primary Examiner* — Lee D Wilson
*Assistant Examiner* — Tyrone V Hall, Jr.
(74) *Attorney, Agent, or Firm* — Fitch, Even, Tabin & Flannery LLP

(57) ABSTRACT

A crimp control apparatus includes a threaded connection between a dipper and a punch to adjust the distance between the die and the bottom of the cylinder. In one aspect, the apparatus includes a cylinder, a connector, and a cylinder mount bracket, the cylinder mount bracket bore having threads engagable to threads of the connector, and a lock in the cylinder mount bracket to restrict movement of the connector through the cylinder mount bracket bore. In another aspect, the apparatus includes a cylinder, a piston within the cylinder and having a piston shaft, a stud extending from the piston shaft and having threads, a punch holder having threads engagable to the threads of the stud, a lock to lock the position of the stud and the punch holder, and an adjustment device in the piston shaft.

16 Claims, 5 Drawing Sheets

CRIMP CONTROL APPARATUS

BACKGROUND OF THE INVENTION

This invention relates to the use of a clipper to enclose material in bags, tubular casing, or netting and to control crimp. Clippers are conventionally used to enclose food products such as poultry in plastic bags, to enclose pasty sausage material in tubular casing, and to enclose sausages or hams in netting, as well as for numerous other applications. Clippers can be manual or automatic. Automatic clippers use powered cylinders, usually air-actuated, to provide a downstroke on a punch. Manual clippers generally use a lever to actuate the downstroke of the punch. In either type of clipper, the punch engages a clip, which is then forced around a gathered neck of the bag, easing, or netting, and against a die, which forces or "crimps" the legs of the clip closed to seal the hag, casing, or netting. A type of automated neater using a clipper is described in U.S. Pat. No. 6,883,297, Apparatus for Enclosing Material in a Net, the disclosure of which is incorporated herein by reference. Clips are described in U.S. Pat. No. 7,565,780, Clip and Clipper, the disclosure of which is incorporated herein by reference.

Precise control of crimp is necessary for optimum operation. The punch of the clipper must travel an appropriate distance to cause the clip to crimp properly. This distance varies with different types of clips, which might be different sizes. The distance also varies with differently-sized bags, casings, and nets, if the punch travels too short a distance, the clip is not crimped sufficiently tightly and will not properly enclose the bag, casing, or netting. The enclosed material then can escape the enclosure, resulting in unsanitary and unsavory conditions. Additionally, sometimes material is vacuum packed, as described in, for example, United States Published Patent Application No. 2011/0107726 A1, Method and System for Bagging Material, the disclosure of which is incorporated herein by reference. For example, it is known to enclose a whole bird in a plastic bag, evacuate the bag, and seal the bag with a clip. Vacuum packing of, for example, chicken, produces a tight appearance that is pleasing to consumers. A loose clip, however, will cause the bag to lose vacuum.

Moreover, if the distance the punch travels is too far, the clip is crimped too tightly, causing similar problems to arise. A clip crimped too tightly can cut the bag or casing, causing one or more of a leak of the contents, a loss of vacuum, and contamination of the material.

Accordingly, precise control of crimp is important when bagging material. The amount of adjustment needed might be very small, as small as four millimeters or less, but it is nevertheless critical to proper casing, bagging, and/or netting operation.

One prior-art method of crimp control uses a cam within the air-actuated cylinder. Modern air-actuated cylinders can use air actuation for both the downstroke and the return stroke. The cam arrangement, however, only permitted air actuation of the downstroke of the piston. Accordingly, a spring was used to cause the piston to rebound to the top of the cylinder.

Another prior-art method of crimp control uses screws to adjust the height of the die. The screws could stick or freeze, however, after extended periods of time, especially if not maintained well, causing difficulties when crimp had to be adjusted.

The present invention is an improved apparatus for control of crimp during clipping operations.

BRIEF SUMMARY OF THE INVENTION

The crimp control apparatus of the preferred embodiment of the present invention comprises an adjustable connector between the punch and the actuator moving the punch, to adjust the distance between the die and air cylinder. Components of the apparatus can be rotated to move axially along a threaded connection and thereby adjust this distance.

In one aspect of the invention, an apparatus comprises an air-actuated cylinder having a proximal end and a distal end and a bore at the proximal end of the cylinder, the bore having internal threads, a connector comprising a first section having a proximal side and a distal side, and a second section extending from a proximal side of the first section, the first section having external threads engagable into the internal threads of the bore of the cylinder, the second section having external threads, a bore through the connector and the first and second sections, a cylinder mount bracket having a bore, the bore having a depth and internal threads through at least a portion of the depth of the bore, the internal threads engagable to the external threads of the second section of the connector, a piston within the cylinder and movable within the cylinder, the piston comprising a shaft extending through the connector bore and the cylinder mount bracket bore, a shaft seal within the connector bore, and a lock for restricting movement of the connector through the cylinder mount bracket bore.

In another aspect of the invention, an apparatus comprises an actuator having a shaft, a connector comprising s stud extending from the shaft, the stud having threads, a punch holder having threads engage able to the threads of the threaded stud, and a lock to lock the position of the punch holder on the stud, the shaft also having an adjustment device.

BRIEF DESCRIPTION OF THE VIEWS OF THE DRAWINGS

The organization and manner of the structure and operation of the invention, together with further objects and advantages thereof, may best be understood by reference to the following description, taken in connection with the accompanying non-scale drawings, wherein like reference numerals identify like elements in which.

DESCRIPTION OF THE PREFERRED EMBODIMENTS OF THE INVENTION

Figure 1:
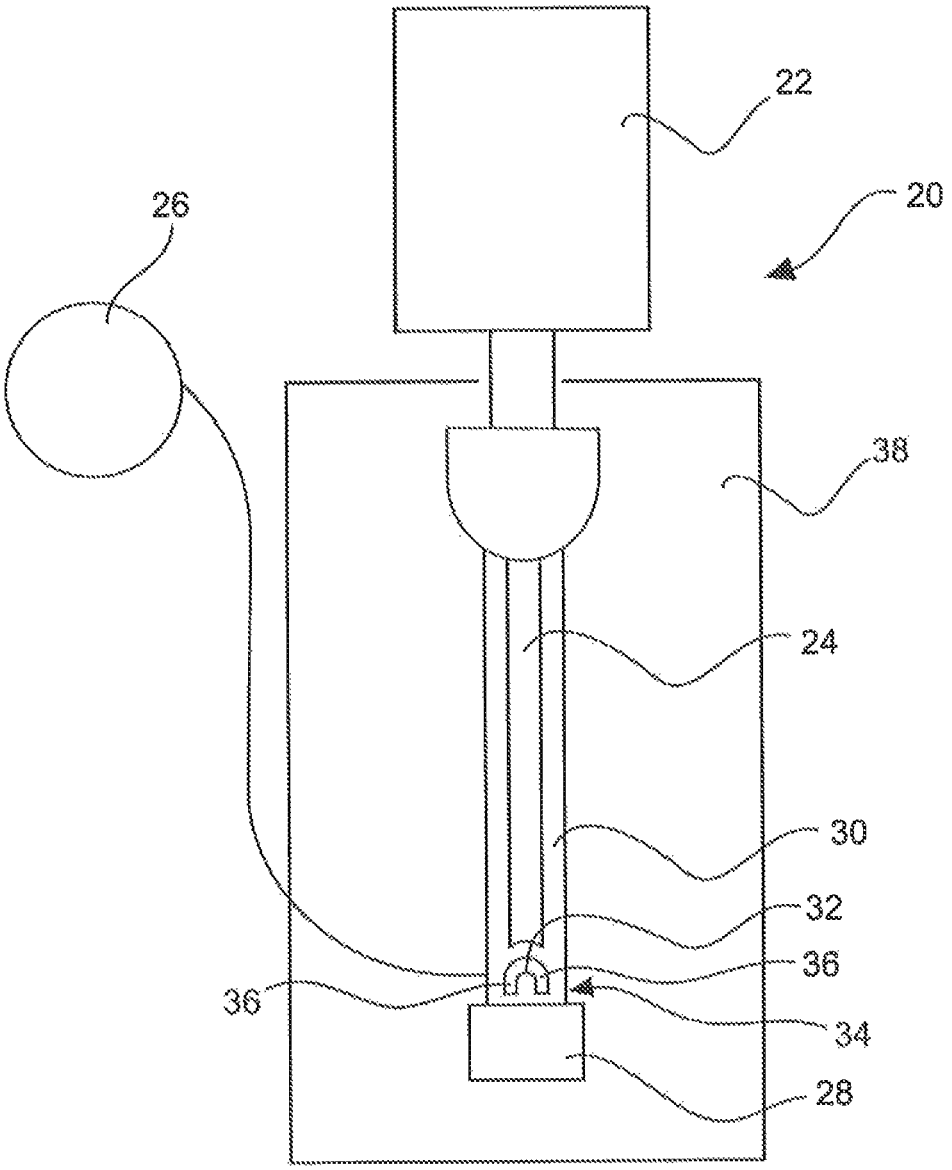
Fig. 1 Prior Art
FIG. 1 is a diagrammatic view of a clipper/stuffer combination as known in the prior art.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein. The embodiments of the present invention will be described as part of an automated clipper to be mounted on a system for making sausage. The present invention, however, can also be used on clippers on systems for bagging and/or netting whole poultry, cut-up poultry, or Whole muscle meat products. The present invention can also be used on other applications in which material is enclosed in a casing, bag, or netting, including such material as sealants, adhesives, and explosives. The present invention can also be used for any other application in which one or more clippers is used and crimp control is desired, including both manual and automated clippers.

An automated clipper 20 as known in the prior art in general comprises a cylinder 22 or other actuator, a punch 24 connected to cylinder 22, a clip supply 26, and a die 28, as shown in FIG. 1. Punch 24 rides along guide rail 30. Clips 32 are fed into the space 34 between punch 24 and die 28. Air pressure in cylinder 22 moves punch 24 between a first position proximal to die 28 and a second position distal to die 28. When a downstroke of cylinder 22 causes punch 24 to descend from the second position to the first position and onto a single clip 32, punch 24 pushes the legs 36 of clip 32 against die 28 to close or "crimp" clip 32, sealing whatever was between legs 36, be it a bag, a casing, a net, or a combination thereof. Retraction of cylinder 22 from the first position to the second position causes punch 24 to rise away from die 28 and the process can repeat. Clipper 20 in the preferred embodiment is mounted on an automatic stuffer 38, such as a TSCA 160 Automatic Sealing/Clipping Machine sold by Poly-clip System, Mundelein, Ill., US, but can also be a free-standing clipper. A manually-operated clipper as known in the prior art is similar to automated clipper 20 except the actuator is a lever.

Figure 2:
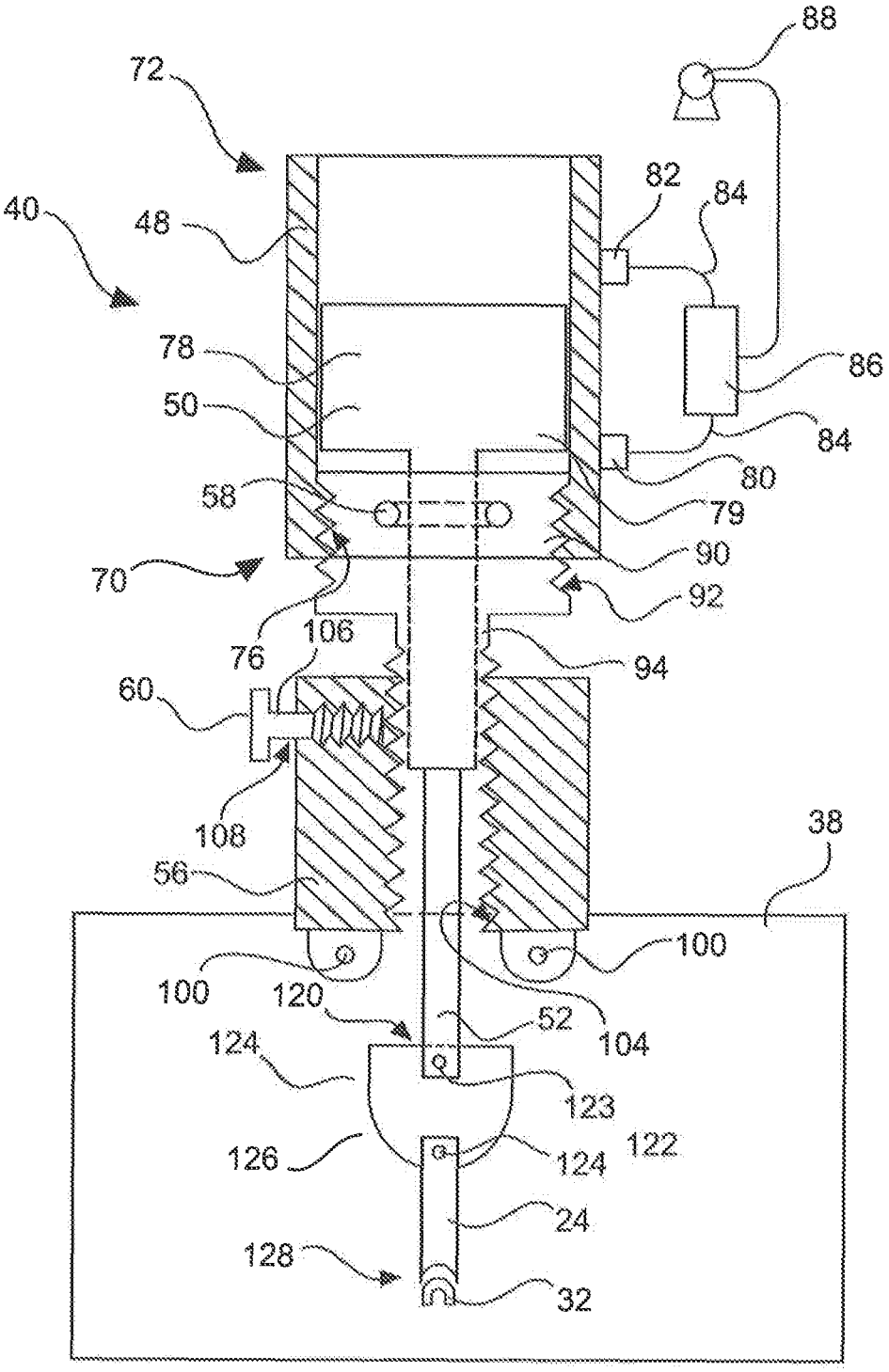
FIG. 2 is a diagrammatic view of the crimp control apparatus of a preferred embodiment of the present invention, in disassembled status.

The components of a first preferred embodiment of the crimp control apparatus 40 of the present invention are shown in diagrammatic form in FIG. 2. Crimp control apparatus 40 in this embodiment is mounted to automated stuffer 38. Stuffer 38 could also be a netter as described in U.S. Pat. No. 6,883,297, or could be a manually-operated clipper.

Crimp control apparatus of the first preferred embodiment comprises cylinder 48, a piston 50 having a piston shaft 52, a connector 54, a cylinder mount bracket 56, a shaft seal 58, and a lock 60. Connector 54 is a connector between cylinder 48 and cylinder mount bracket 56.

Cylinder 48 of the preferred embodiment is air actuated. Alternatively, cylinder 48 can be manual, electric, or some other design. In the preferred embodiment, cylinder 48 has a proximal end 70 and a distal end 72. Cylinder 48 is a tubular casing sealed at distal end 72. At proximal end 70, cylinder 48 has a counterbore 74 with internal threads 76.

Piston 50 has a main body 78 fitting within the tubular housing of cylinder 48. Piston shaft 52 extends from the proximal end 79 of main body 78. Main body 78 and piston shaft 52 move axially within cylinder 48 and is either machined to be reasonably air-tight or has conventional piston rings for that purpose.

Cylinder 48 has a proximal air port 80 and a distal air port 82. Each air port 80, 82 is connected by tubing 84 to controller 86. Controller 86 is connected to a pressurized air supply, preferably through a plant air system supplied by air pump 88. Controller 86 operates in a conventional manner, automatic or manual, to direct pressurized air alternatively into distal air port 82 and out of proximal air port 80, to cause piston 50 to make a downstroke toward proximal end 70 of cylinder 48, or into proximal air port 80 and out of distal air port 82, to cause piston 50 to retract toward distal end 72 of cylinder 48. Alternatively, cylinder 48 could have relief valves, not shown to vent air from one end as pressurized air is directed into the other end. Controller 86 can be an electronic air pressure controller that converts an electronic signal into a controlled air pressure output or can be a manually-operated mechanical controller, or some other means of divert air into one port or another.

Connector 54 has a first section 90, a disc having a radius approximately equal to the radius of counterbore 74 of cylinder 48. First section 90 has circumferential external threads 92 engagable or matable to threads 76 of counterbore 74 of cylinder 48, so first section 90 attaches to proximal end 70 of cylinder 48. Preferably, threads 76 and 92 are machined sufficiently well to seal cylinder 48, but an O-ring, high pressure lubricant, mechanical seal, or similar means may also be used to seal the connection between first section 90 and cylinder 48.

Connector 54 has a second section 94 extending from first section 90 on the side opposite cylinder 48. Second section 94 preferably has a radius smaller than the radius of first section 90. Second section 94 has circumferential external threads 96.

A bore 98 extends axially through connector 54. Bore 98 preferably has a radius slightly greater than the radius of piston shaft 52 in order to accommodate piston shaft 52, which moves axially through bore 98. Preferably, shaft seal 58 within bore 98 seals around piston shaft 52 to maintain pressure within cylinder 48. Shaft seal 58 is preferably an O-ring but can also be a high pressure lubricant, mechanical seal, or similar means.

Cylinder mount bracket 56 is disc-shaped with mounting holes 100 for securing cylinder mount bracket 56 to the main frame of clipper 20 or to stuffer 38. Holes 100 can be threaded to accommodate machine screws for this purpose, or can be unthreaded holes aligning to brackets on clipper 20 or stuffer 38 to accommodate tap bolts, pins, or other mounting means. Cylinder mount bracket 56 can be integral to clipper 20 or stuffer 38, as the function of cylinder mount bracket 56 is to hold the combination of cylinder 48 and connector 54 securely over die 28.

A bore 102 extends axially into cylinder mount bracket 56 and has internal threads 104. Threads 104 are engagable with threads 96 of second section 94 of connector 54. Lock 60 is used to lock second section 94 within cylinder mount bracket 56 and restrict movement of second section 94. As illustrated, lock 60 comprises set screw 106, which threads into aperture 108 radially through cylinder mount bracket 56 to lock second section 94 within cylinder mount bracket 56. Alternatively, a jam nut can be used on second section 94, as will be hereinafter described.

Figure 3:
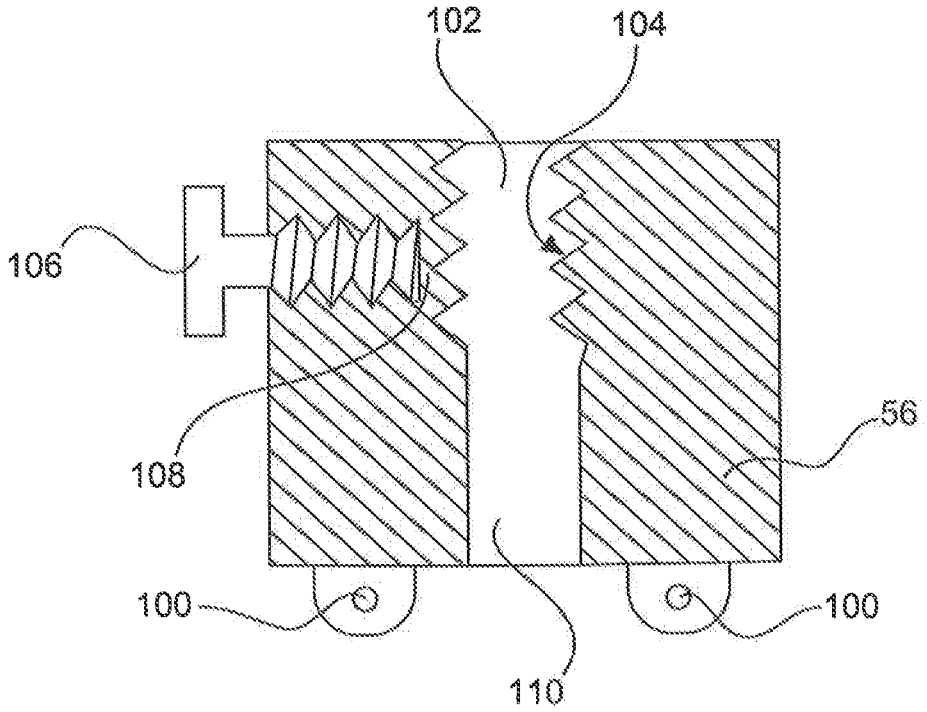
FIG. 3 is a diagrammatic view of another embodiment of the cylinder mount bracket of the apparatus of FIG. 2.

Bore 102 can extend axially the entire depth of cylinder mount bracket 56. In another embodiment, bore 102 extends axially only partially the depth of cylinder mount bracket, and an additional unthreaded bore 110 extends the rest of the way, as shown in FIG. 3. Additional bore 110 has a radius just greater than the radius of piston shaft 52 in order to accommodate piston shaft 52, which moves axially through additional bore 110.

When crimp control apparatus 40 is assembled, connector 54 is screwed tightly into cylinder 48 via threads 74, 92, sealing piston 50 within counterbore 74. Connector 54 is then screwed into cylinder mount bracket 56. Piston shaft 52 extends through bore 98 of connector 54 and through bore 102 of cylinder mount bracket 56 and, if present, through additional bore 110. Pressure within cylinder 48 is preferably maintained by shaft seal 58.

The proximal end 120 of piston shaft 52 connects to a punch holder 122, preferably by set screw 123. Alternatively, threads, bolts, interference fit, or other similar type of fastening device can be used. Punch holder 122 connects to punch holder 122 preferably by set screw 124. Alternatively, threads, bolts, interference fit, or other similar type of fastening device can be used. Proximal end 128 of punch 24 engages clip 32.

Movement of piston 50 within cylinder 48 causes piston shaft 52 to move axially within bore 98 and 102 and, if present, through additional bore 110. When pressurized air is let into distal air port 82, piston 50 moves downward toward proximal end 70 of cylinder 48, exhausting air out of proximal air port 80 and causing punch 24 to move along guide rail 30 onto clip 32, forcing legs 36 of clip 32 against die 28 to crimp clip 32. When pressurized air is routed to proximal air port 80, piston 50 is moved upward toward distal end 72 of cylinder 48, air is exhausted out of distal air port 82, and the process repeats.

Because cylinder 48 is attached tightly to connector 54, those two components can rotate together. Cylinder mounting bracket 56 is firmly fixed to clipper 20 or to stuffer 38, so it will not rotate. When set screw 106 is loosened, rotation of cylinder 48 by a user causes second section 94 to rotate within bore 102 of cylinder mounting bracket 56, causing second section 94 to move more deeply or more shallowly within bore 102.

Rotating cylinder 48 to the right (or clockwise, looking from the top) will cause second section 94 to engage more deeply into bore 102, thereby shortening the distance from the point at which piston 50 is at its bottom-most point in cylinder 48, to die 28, thereby increasing the amount of crimp. Rotating cylinder 48 to the left will cause second section 94 to engage more shallowly into bore 102, thereby lengthening the distance from the point at which piston 42 is at its bottom-most point in cylinder 48, to die 28, thereby decreasing the amount of crimp. A user can therefore rotate cylinder 48 to achieve the correct amount of crimp, and then tighten set screw 106 to engage against second section 94, thereby locking second section 94 within bore 102. Crimp control is therefore accomplished by rotation of cylinder 48, preferably by hand but also by grips if necessary.

Figure 4:
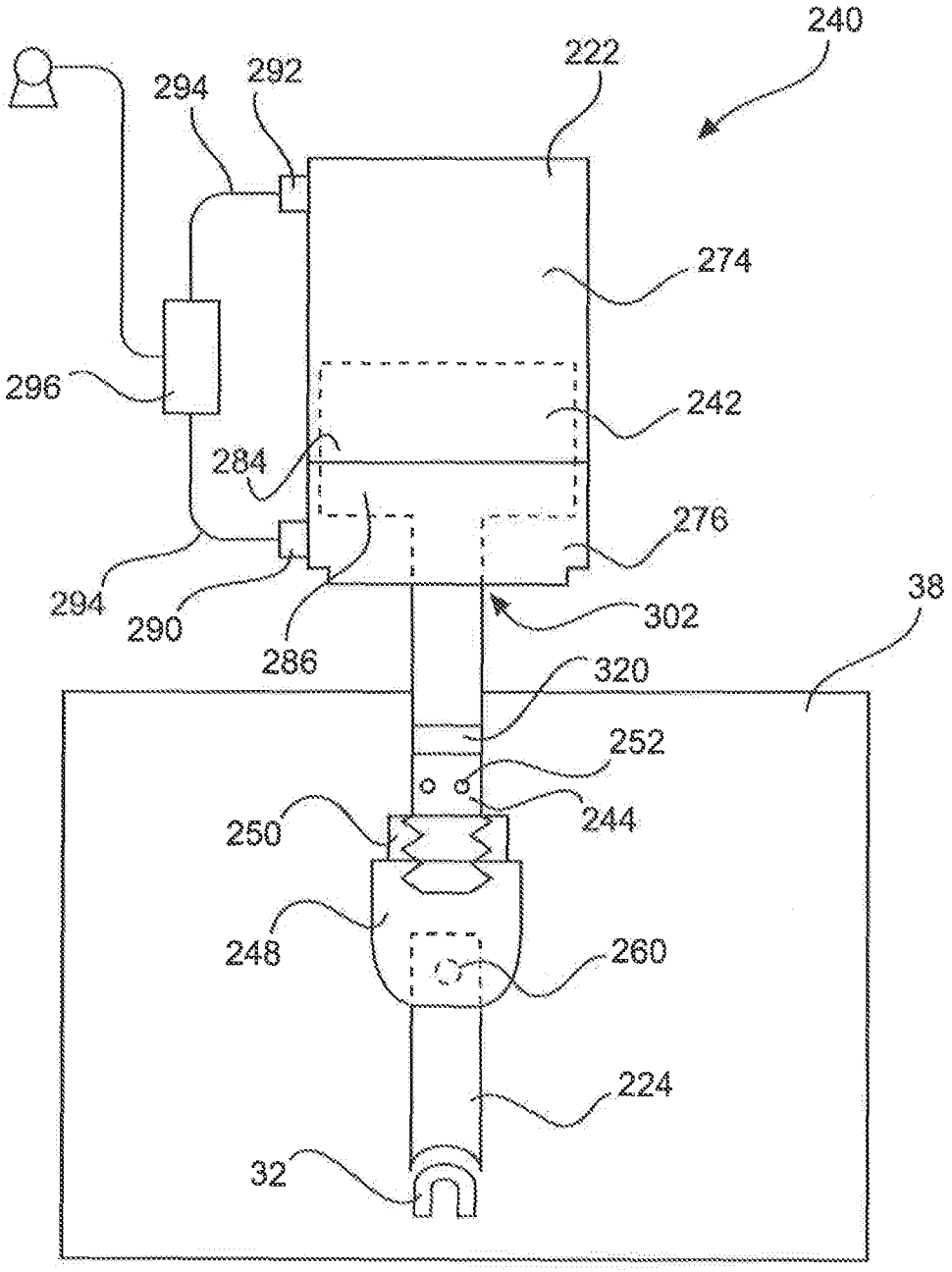
FIG. 4 is a diagrammatic view of another embodiment of the present invention as assembled.
Figure 5:
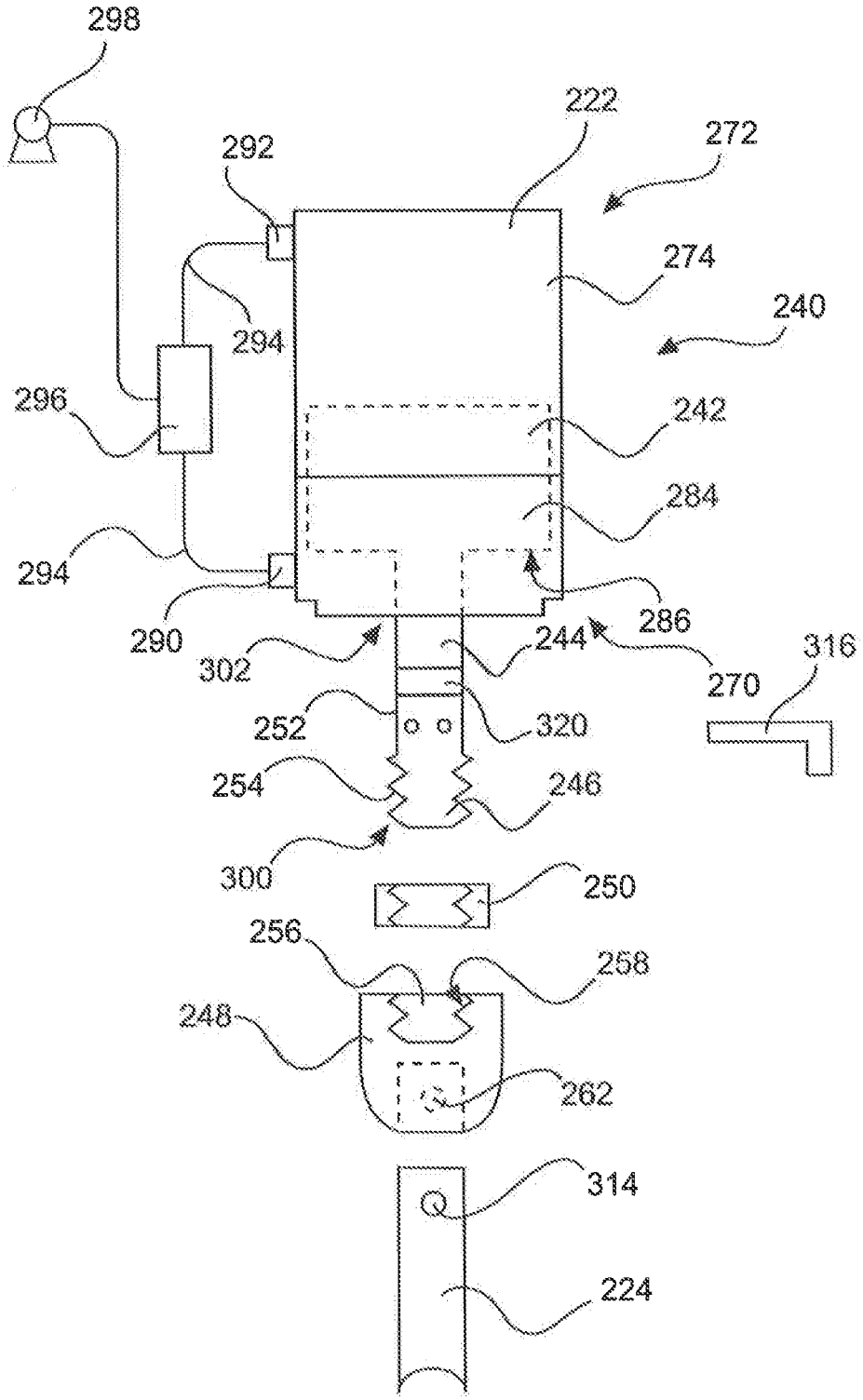
FIG. 5 is a diagrammatic view of the crimp control apparatus of FIG. 4, disassembled.

A second embodiment of the present invention is crimp control apparatus 240, shown in diagrammatic form as assembled in FIG. 4 and as partially disassembled in FIG. 5. Crimp control apparatus 240 is described as mounted to automated stuffer 38. Stuffer 38 could also be a netter as described in U.S. Pat. No. 6,883,297, or could be a manually-operated clipper.

Crimp control apparatus 240 comprises cylinder 222, a piston 242 having a piston shaft 244 from which a threaded stud 246 extends, a punch holder 248, a jam nut 250, and at least one adjustment aperture 252 in shaft 244. In use, jam nut 250 is threaded onto the threads 254 of stud 246. Stud 246 is threaded into the threaded bore 256 of punch holder 248, mating with threads 258 of bore 256. Punch 224 preferably is attached to punch holder 248 by a fastener 260 through an aperture 262 in punch holder 248. Punch 224 could also be connected to punch holder 248 by threads, welding, glue, or other means.

Cylinder 222 of the preferred embodiment is air actuated. Alternatively, cylinder 222 can be manual, electric, or some other design. In the preferred embodiment cylinder 222 has a proximal end 270 and a distal end 272. Cylinder 222 has a tubular main casing 274 to which an end cap 276 is connected to form the proximal end 270 of cylinder 222. Preferably, end cap 276 threads into main casing 274, with an O-ring or other suitable gasket sealing the connection, but other means of connecting end cap 276 to main casing 274 can be used, so long as the joint between main casing 274 and end cap 276 is reasonably sealed to pressurized air. Please note that cylinder 222 of the preferred embodiment is made of two parts, main casing 274 and end cap 276, for ease of assembly, but cylinder 222 could be made in another manner.

Piston 242 has a main body 284 fitting within the tubular housing of cylinder 222. Main body 284 moves within cylinder 222 and is either machined to be reasonably air-tight or has conventional O-rings or piston rings for that purpose. Piston shaft 244 extends from the proximal end 286 of main body 284, exiting cylinder 222 through an aperture 302 in end cap 276. Aperture 302 is sealed, preferably by an O-ring but alternatively by some other sealing means that provides a reasonable seal to pressurized air.

Cylinder 222 has a proximal air port 290 and a distal air port 292. Each air port 290, 292 is connected by tubing 294 to controller 296. Controller 296, like controller 86, is connected to a pressurized air supply, preferably through a plant air system supplied by air pump 298. Controller 296 operates in a conventional manner, automatic or manual, to direct pressurized air alternatively through air port 292, to cause piston 242 to make a downstroke toward proximal end 270 of cylinder 222, or through air port 290, to cause piston 242 to retract toward distal end 272 of cylinder 222. Preferably, air exhausts through one of air port 290, 292 when pressurized air is directed into the other of air port 290, 292, or relief valves could be used instead.

Stud 246 extends from the proximal end 300 of piston shaft 244. In the preferred embodiment, stud 246 is integral to piston shaft 244. Stud 246 is preferably formed from a single billet with piston shaft 244, but can be a separate piece permanently attached to piston shaft 244 by welding or other operation. In other embodiments, stud 246 is demountably engaged to piston shaft 244. For examples, stud 246 can be threaded into piston shaft 244 or piston shaft 244 can be threaded into stud 246. Moreover, other means of engaging stud 246 to piston shaft 244 can be used, such as a key and latch assembly, rivets, screws, glue, or weld.

Jam nut 250 is preferably a hexagonal locking nut with threads matching threads 254 of stud 246. After jam nut 250 is threaded to threads 254, punch holder 248 is engaged to stud 246. Threads 258 in bore 256 match threads 254 of stud 246. Punch holder 248 attaches to stud 246 by threading stud 246 into bore 256. Jam nut 250 is used to lock the position of punch holder 248 on stud 246. Other securing means can be used, such as a set screw in punch holder 248, similar to set screw 106.

Punch holder 248 has a slot 306 in the proximal end 308 of punch holder 248, into which the distal end 310 of punch 224 is inserted. Preferably, fastener 262 holds distal end 310 in slot 306. Other means of attachment can be used, such as set screws, threads, glue, welds, interference fit, or lock and key.

There is at least one adjustment device in piston shaft 244, at a location distal to threads 254. In one embodiment, the adjustment device in shaft 244 is one, preferably two or more, and most preferably three adjustment apertures 252 spaced equally circumferentially (every sixty degrees) around piston shaft 244. Adjustment apertures 252 can be any shape but preferably are sized to engage an Allen wrench, as will be hereinafter explained. In another embodiment, the adjustment device of piston shaft 244 is a portion 320 machined to have a regular polygonal cross-section, preferably hexagonal but any shape that will meet a conventional open-ended wrench will suffice.

Rotation of piston shaft 244 is accomplished by placing a tool 316 into one of apertures 252 and rotating piston shaft 244 in one direction or another. Tool 316 is preferably an Allen wrench or a star screwdriver such as one sold under the trade name TORX®. Tool 316 can be any lever, wrench, or screwdriver will apply a torque to rotate shaft 244. Guide rail 30 constrains rotation of punch 224, but piston 242 rotates freely within cylinder 222. Accordingly, moving tool 316 circumferentially in one direction or another will cause piston 242 to rotate, whereupon piston shaft 244 will rotate, whereupon stud 246 will rotate within bore 256, going more deeply or more shallowly into punch holder 248 and decreasing or increasing the amount of crimp.

Alternatively, instead of the user inserting tool 316 into aperture 252 to rotate piston shaft 244, the user engages portion 320 with a wrench to rotate piston shaft 244.

Operation of controller 296 causes piston 242 to downstroke and retract. The downstroke of piston 242 causes proximal end 308 of punch 224 to engage the top of a clip 32 in a standard manner, pushing the clip legs 36 against die 28 and causing clip 32 to close and seal the bag and/or netting. Control of the amount of crimp of clip 32 is accomplished by adjustment of the extent to which stud 246 engages bore 256. If punch 224 travels too far on the downstroke, too much crimp will occur; if punch travels not far enough, not enough crimp will occur. The operator of crimp adjustment apparatus 240 can adjust crimp by engaging stud 246 more deeply or more shallowly in bore 256. Rotating piston shaft 244 to the right (clockwise, as viewed from the top, if the threads are standard, as is preferred) will cause stud 246 to engage more deeply into bore 256, thereby shortening the distance from the point at which piston 242 is at its bottom-most point in cylinder 222, to die 28, thereby decreasing the amount of crimp. Rotating piston shaft 44 to the left will cause stud 46 to engage more shallowly into bore 56, thereby lengthening the distance from the point at which piston 242 is at its bottom-most point in cylinder 222, to die 28, thereby increasing the amount of crimp.

Please note that a manual clipper can use this embodiment as well, replacing the air-actuated cylinder 222 with the manual lever known in the art (not shown).

Please note that jam nut 250 could be used on second section 94 of connector 54 in the embodiment described in FIG. 2 and accompanying text in the place of set screw 106. In this embodiment, jam nut 250 locks second section 94 to cylinder mount bracket 56.

While preferred embodiments of the present invention are shown and described, it is envisioned that those skilled in the art may devise various modifications of the present invention without departing from the spirit and scope of the appended claims.

We claim:

1. A crimp control apparatus comprising:

an air-actuated cylinder comprising a proximal end and a distal end and a bore at the proximal end of the cylinder, the bore having internal threads;

a connector comprising a first section having a proximal side and a distal side and external threads engagable into the internal threads of the bore of the cylinder;

a second section extending from the proximal side of the first section, the second section having external threads, and a bore through the first section and the second section;

a cylinder mount bracket having a bore, the bore having a depth and having internal threads through at least a portion of the depth of the bore, the internal threads engagable to the external threads of the second section;

a piston within the cylinder and movable within the cylinder, the piston comprising a shaft extending axially through the connector bore and the cylinder mount bracket; and a lock for restricting movement of the connector through the cylinder mount bracket bore.

2. The crimp control apparatus of claim 1, wherein the lock comprises a set screw or a jam nut.

3. The crimp control apparatus of claim 1, wherein the cylinder mount bracket bore is a counterbore, the cylinder mount bracket comprises an additional bore, and the piston shaft extends additionally axially through the additional bore.

4. A clipper comprising the crimp control apparatus of claim 1.

5. The clipper of claim 4 mounted on a stuffer or a netter.

6. The crimp control apparatus of claim 1, wherein the first section has a radius and the second section has a radius smaller than the radius of the first section.

7. A crimp control apparatus comprising:

an actuator having a shaft;

a connector comprising a stud extending from the shaft, the stud having threads;

a punch holder having a threads engageable to the threads of the threaded stud; and a lock to lock the position of the punch holder on the stud;

the shaft having an adjustment device, the adjustment device comprising an adjustment aperture or a polygonal portion.

8. The crimp control apparatus of claim 7, wherein the actuator comprises:

a cylinder having a proximal end and a distal end and an aperture in the proximal end; and a piston within the cylinder and movable within the cylinder, the piston comprising the shaft, the shaft extending through the aperture in the proximal end of the cylinder.

9. The crimp control apparatus of claim 7, wherein the lock comprises a jam nut or a set screw.

10. The crimp control apparatus of claim 7, wherein the threaded stud and the shaft are integrally formed.

11. The crimp control apparatus of claim 7, wherein the threaded stud is demountably engaged to the piston shaft.

12. The crimp control apparatus of claim 7, wherein the cylinder comprises a casing and an end cap.

13. The crimp control apparatus of claim 7, wherein the cylinder further comprises a distal air port and a proximal air port, each said port connected to a pressurized air supply.

14. A clipper comprising the crimp control apparatus of claim 7.

15. The clipper of claim 14 mounted on a stuffer or a netter.

16. A crimp control apparatus for use on a clipper having a die, the crimp control apparatus comprising:

a punch;

means for moving the punch between a position proximal to the die and a position distal from the die; and means for adjusting the distance the punch travels between the proximal position and the distal position.

* * * * *